US006155568A

United States Patent [19]

Franklin

[11] Patent Number: 6,155,568

[45] Date of Patent: Dec. 5, 2000

[54] THREE-HAND POKER GAME METHOD

[76] Inventor: Thomas L. Franklin, 810 Ford St., Gulfport, Miss. 39507

[21] Appl. No.: 09/507,395

[22] Filed: Feb. 18, 2000

[51] Int. Cl.[7] ..... A63F 1/00

[52] U.S. Cl. ..... 273/292

[58] Field of Search ..... 273/292, 274, 273/309; 463/13

[56] References Cited

U.S. PATENT DOCUMENTS

| | | | |
|---|---|---|---|
| 5,098,107 | 3/1992 | Boylan et al. | 273/292 |
| 5,294,128 | 3/1994 | Marquez | 273/292 |
| 5,580,061 | 12/1996 | Kong | 273/292 |
| 5,584,486 | 12/1996 | Franklin | 273/292 |
| 5,601,488 | 2/1997 | Kadlic | 463/13 |
| 5,607,161 | 3/1997 | Skratulia | 273/292 |
| 5,725,216 | 3/1998 | Jones | 273/292 |
| 5,868,618 | 2/1999 | Netley et al. | 463/13 |
| 5,931,472 | 8/1999 | Ko | 273/292 |
| 5,951,012 | 9/1999 | Feola | 273/292 |
| 6,007,424 | 12/1999 | Evers et al. | 463/13 |
| 6,070,876 | 6/2000 | Ko | 273/292 |

*Primary Examiner*—Sebastiano Passaniti
*Assistant Examiner*—Dolores Collins
*Attorney, Agent, or Firm*—Anderson, Morishita, LLC; Philip J. Anderson

[57] ABSTRACT

A method for playing a Poker-type game is set forth which includes the player making a wager. A 7-card hand is dealt to each player and to the dealer, from which each assembles a 2-card low hand, a two card middle hand and a 3-card high hand. The dealers' and players' hands are compared, based upon Poker rankings. For the player to win, at least two of his hands must have a higher rank than the corresponding dealer's hands. Tie rankings are resolved in favor of the dealer. All other outcomes are losses or ties. The player is paid on their wager for winning hands.

4 Claims, No Drawings

THREE-HAND POKER GAME METHOD

FIELD OF THE INVENTION

The present invention relates to methods for playing Poker-type card games.

BACKGROUND

Poker games using playing cards are popular and well known. In one such game known as Pai Gow Poker is played in many casinos and card clubs. To play the game the players each make a wager to play a hand. Seven cards are dealt to each player and the dealer. From the seven cards, each player makes a two card low hand and a five card high hand. The high hand must have a Poker ranking higher than that of the low hand. In my patent JACKPOT PAI GOW POKER, U.S. Pat. No. 5,584,486 issued Dec. 17, 1996, the disclosure of which is hereby incorporated by reference, the game of Pai Gow Poker is described.

Each player's hand is compared to the dealer's hand. If both the player's high and low hands outrank the dealer's corresponding high and low hands, the player is paid even money on their wager. Conversely, if both the dealer's hands outrank the player's, the player loses their wager which is collected by the dealer. Where one of the player's hands outranks the corresponding hand of the dealer but the other does not, the hand is declared a draw or "push".

On player winning hands, the casino exacts a commission of typically 5%.

A drawback to the traditional game of Pai Gow Poker is that approximately 40% of the hands result in a push. Thus, for this percentage of hands, there is no winner or loser and hence no commission or win for the casino.

One method advanced to reduce the number of pushes is described in Kong, U.S. Pat. No. 5,580,061 which adds the values of the cards of the player's and dealer's hands to determine whether the sum is odd or even and declaring a winner if both values are odd or even.

It would be advantageous to provide a game which includes the strategy of assembling multiple hands and eliminates ties.

SUMMARY OF THE INVENTION

There is, therefore, provided according to the present invention a method for playing a three hand Poker game which eliminates ties or pushes. Toward this end the method is directed to a Poker game of the type played with a standard, 52 card deck of playing cards and also including a Joker. The Joker is wild as a Ace or to complete a straight. The method includes the player making a wager and dealing from the deck seven cards to form a player holding and seven cards to form a dealer holding. From each holding, player and dealer hands are assembled into a two card low hand, a two card middle hand and a three card high hand, with the high hand having a higher Poker-like ranking than the middle hand and the middle hand having a higher ranking than the low hand. The rankings of the player's high, middle and low hands are compared to the corresponding high, middle and low hands of the dealer and (1) if two or more of the player's hands have a higher ranking than the dealer's declaring the player hand the winner, (2) if two or more of the dealer's hands have a greater or equal ranking compared to the player's corresponding high, middle and low hands, declaring the dealer hand the winner.

If the player's hand is declared the winner the player is paid based upon their wager, preferably even money. If desired, the casino hosting the game may exact a commission, e.g. 5% on player winning hands. For dealer winning hands, the player's wager is lost and is collected by the dealer.

The method eliminate ties or pushes by providing three hands and declaring the winner the hand that wins at least two of the hands. Further, ties are eliminated by establishing a protocol that for all tie rankings, the dealer's hand is deemed to be the prevailing hand. Thus for each hand there will be a winning and a losing hand.

The method may be embodied as a table game or in an electronic gaming machine.

DESCRIPTION

According to the method of the present invention, the player makes a wager to play the game. The game may be played on a table layout such as that used for Pai Gow, Baccarat, Blackjack and the like. Seven playing cards from a standard deck of fifty-two cards plus a Joker (fifty-three cards total) are dealt to each player and to the dealer. As with conventional Pai Gow, the Joker can substitute as an Ace or to fill a Straight or to fill a flush.

From the seven cards, the player assembles three hands: a two card low hand, a two card middle hand and a three card high hand. The three card high hand must have a higher ranking than the two card middle hand which, in turn, must have a ranking higher than the two card low hand. For example, the following hands for a player and dealer would be assembled into three hands:

| | Player | Dealer |
|---|---|---|
| Initial deal: | A,A,K,Q,5,5,5 | Q,Q,10,9,B,4,3 |
| Low hand: | K,Q | 4,3 |
| Middle Hand: | A,A | Q,Q (Pairs) |
| High Hand: | 5,5,5 | 10,9,8 (Straights or Straight Flushes) |

The rankings of the two card hands, from highest to lowest, are as follows:

Pairs: (A,A), (K,K), (Q,Q), (J,J), (10,10), (9,9), (8,8), (7,7), (6,6), (5,5), (4,4), (3,3), (2,2);

Ranked Value: (A,Q), (A,J), etc.

The ranking for the three card hands are as follows:

Royal Flush (Suited A,K,Q)

3-Card Straight Flush

Three of a Kind

3-Card Straight

3-Card Flush

Pair

Highest three cards

The player is declared the winner and paid even money on his wager if at least two of his three hands outrank the corresponding hands of the dealer. That is, the player's high hand is compared to the dealer's high hand, the middle hands are compared as are the low hands. If two or more of the dealer's corresponding hands tie or outrank the corresponding hands of the player the dealer is declared the winner and the player's wager is collected. All tie rankings of corresponding hands are deemed to have a higher ranking in favor of the dealer.

A commission is assessed as to all player winning hands.

Thus there will be no ties in this game. Every hand for all players will result in either a house (dealer) win and collection of the player's wager or a player win with a commission collected by the house.

As can further be appreciated, the method can be incorporated into an electronic gaming machine.

While I have shown and described certain embodiments of the present invention, it is to be understood that it is subject to many modifications without departing from the spirit and scope of the appended claims.

I claim:

1. A method for playing a Poker game using a 52 card deck of playing cards and a Joker which can represent an Ace or to fill a straight or flush, the method comprising:

the player making a wager;

dealing from the deck seven cards to form a player holding and to form a dealer holding, for each of said player and dealer hands assembling them into a two card low hand, a two card middle hand and a three card high hand, said hands having descending Poker rankings of high hand, middle hand and low hand;

comparing the rankings of the player's high hand, middle hand and low hand to the dealer's high, middle and low hands and (1) if at least two of the player's hands have a higher rankings than the corresponding dealer's hands, declaring the player hand the winner, (2) if two or more of the dealer's hands outrank or have a tie ranking with the corresponding the player's hands, declaring the dealer hand the winner; and for a player winning hand, paying the player based upon his wager and for a dealer winning hand collecting the player's wager.

2. The method of claim 1 including exacting a commission on any player winning hand.

3. The method of claim 1 including providing the following rankings for the hands, 2-Card Hands
- Pairs
- Highest two cards 3-Card Hands
- Royal Flush (Suited A,K,Q)
- Three card Straight Flush
- Three of a Kind
- Three card Straight
- Three card Flush
- Pair
- Highest three cards.

4. A method for playing a Poker game using a 52 card deck of playing cards and a Joker which can represent an Ace or to fill a straight or flush, the method comprising:

the player making a wager;

dealing from the deck seven cards to form a player holding and to form a dealer holding, for each of said player and dealer hands assembling them into a two card low hand, a two card middle hand and a three card high hand, said hands having descending rankings of high hand, middle hand and low hand;

providing rankings for the hands according to the following

2-Card Hands
- Pairs
- Highest two cards

3-Card Hands
- Royal Flush (Suited A,K,Q)
- Three card Straight Flush
- Three of a Kind
- Three card Straight
- Three card Flush
- Pair
- Highest three cards.

* * * * *